US005652085A

United States Patent [19]

Wilson et al.

[11] Patent Number: 5,652,085

[45] Date of Patent: Jul. 29, 1997

[54] SUCCINIC ACID DERIVATIVE DEGRADABLE CHELANTS, USES AND COMPOSITION THEREOF

[75] Inventors: David A. Wilson, Richwood; Druce K. Crump, Lake Jackson, both of Tex.; Eric R. Brown, Webster, N.Y.

[73] Assignee: Eastman Kodak Company, Rochester, N.Y.

[21] Appl. No.: 521,261

[22] Filed: Aug. 30, 1995

[51] Int. Cl.[6] ..... G03C 7/00; G03C 5/44; G03C 5/42; G03C 11/00

[52] U.S. Cl. ..... 430/393; 430/372; 430/428; 430/430; 430/434; 430/461

[58] Field of Search ..... 430/393, 430, 430/461, 372, 428, 434

[56] References Cited

U.S. PATENT DOCUMENTS

| | | | |
|---|---|---|---|
| 3,158,635 | 11/1964 | Kezerian et al. | 260/429 |
| 3,264,107 | 8/1966 | von Wartburg | 96/60 |
| 3,658,535 | 4/1972 | Willems | 96/59 |
| 3,893,858 | 7/1975 | Wabnitz, Jr. | 96/60 R |
| 4,047,956 | 9/1977 | Blake | 96/60 R |
| 4,113,489 | 9/1978 | Sugiyama et al. | 96/60 R |
| 4,294,914 | 10/1981 | Fyson | 430/418 |
| 4,304,846 | 12/1981 | Marthaler et al. | 430/392 |
| 4,563,405 | 1/1986 | Ishikawa et al. | 430/460 |
| 4,702,998 | 10/1987 | Tanaka et al. | 430/430 |
| 4,704,233 | 11/1987 | Hartman et al. | 252/527 |
| 4,707,434 | 11/1987 | Koboshi et al. | 430/393 |
| 4,737,450 | 4/1988 | Hall et al. | 430/460 |
| 4,769,312 | 9/1988 | Kishimoto et al. | 430/384 |
| 4,780,398 | 10/1988 | Kim | 430/461 |
| 4,897,339 | 1/1990 | Andoh et al. | 430/372 |
| 4,933,266 | 6/1990 | Stephen et al. | 430/393 |
| 4,983,315 | 1/1991 | Glogowski et al. | 252/102 |
| 4,985,347 | 1/1991 | Fujimoto et al. | 430/393 |
| 5,110,716 | 5/1992 | Kuse et al. | 430/429 |
| 5,238,791 | 8/1993 | Tappe et al. | 430/393 |
| 5,316,898 | 5/1994 | Ueda et al. | 430/400 |
| 5,338,649 | 8/1994 | Inaba et al. | 430/430 |
| 5,391,466 | 2/1995 | Ueda et al. | 430/430 |

FOREIGN PATENT DOCUMENTS

| | | | |
|---|---|---|---|
| 0 532 003 A1 | 3/1993 | European Pat. Off. . | |
| 0 567 126 A1 | 10/1993 | European Pat. Off. . | |
| 0 584 665 A2 | 3/1994 | European Pat. Off. . | |
| 0 588 289 A2 | 3/1994 | European Pat. Off. . | |
| 0 599 620 A1 | 6/1994 | European Pat. Off. . | |
| 0 683 138 A2 | 11/1995 | European Pat. Off. . | |
| 5-72695 | 3/1993 | Japan | 430/430 |
| 6-324449 | 11/1994 | Japan | 430/430 |
| 94/28464 A1 | 8/1994 | WIPO . | |

OTHER PUBLICATIONS

Derwent Abstract 91–172208/24, 1991.
Derwent Abstract 89–288901, 1989.
Derwent Abstract 89–288902, 1989.
Chemical Abstract 65:11738f, 1966.
Chemical Abstract 102:138591z, 1985.
Chemical Abstract 113:47510h, 1990.
Chemical Abstract 98:117068t, 1983.
J. Majer et al., Chem. Zvesti 20(6), 414–22 (1966) and Chemical Abstract (CA 65:11738f), translation.

*Primary Examiner*—Glenn A. Caldarola
*Assistant Examiner*—J. Pasterczyk
*Attorney, Agent, or Firm*—J. Lanny Tucker; Duane C. Ulmer

[57] ABSTRACT

Aminosuccinic acid chelants are disclosed which have been found to be applicable in photographic processes. The aminosuccinic acids can be used in a method of bleaching or bleach-fixing a silver halide photographic material comprising contacting the photographic material with a bleaching solution containing at least one metal complex of a polyamino disuccinic acid and one or more metal complexes of a polyamino monosuccinic acid or a monoamino monosuccinic acid.

52 Claims, No Drawings

SUCCINIC ACID DERIVATIVE DEGRADABLE CHELANTS, USES AND COMPOSITION THEREOF

This invention relates to photographic processing and in particular to photographic bleach compositions and to methods of photographic processing employing such compositions.

BACKGROUND OF THE INVENTION

Chelants or chelating agents are compounds which form coordinate covalent bonds with a metal ion to form chelates. Chelates are coordination compounds in which a central metal atom is bonded to two or more other atoms in at least one other molecule (called ligand) such that at least one heterocyclic ring is formed with the metal atom as part of each ring.

Chelants are used in a variety of applications including food processing, soaps, detergents, cleaning products, personal care products, pharmaceuticals, pulp and paper processing, water treatment, metalworking and metal plating solutions, textile processing solutions, fertilizers, animal feeds, herbicides, rubber and polymer chemistry, photofinishing, and oil field chemistry. Some of these activities result in chelants entering the environment. For instance, agricultural uses or detergent uses may result in measurable quantities of the chelants being in water. It is, therefore, desirable that chelants degrade after use.

Biodegradability, that is susceptibility to degradation by microbes, is particularly useful because the microbes are generally naturally present in environments into which the chelants may be introduced. Commonly used chelants like EDTA (ethylenediamine tetraacetic acid) are biodegradable, but at rates somewhat slower and under conditions considered by some to be less than optimum. (See, Tiedie, "Microbial Degradation of Ethylenediaminetetraacetate in Soils and Sediments," Applied Microbiology, August 1975, pp. 327–329.) It would be desirable to have a chelating agent which degrades faster than EDTA or other commonly used chelants.

Biodegradation is of particular interest in photography, but finding a commercially useful biodegradable chelant has been difficult. In the production of color photographic images, it is usually necessary to remove the silver image which is formed coincident with the dye image. This can be done by oxidizing the silver by means of a suitable oxidizing agent, commonly referred to as a bleaching agent, in the presence of halide ion, followed by dissolving the silver halide so formed in a silver halide solvent, commonly referred to as a fixing agent. Alternatively, the bleaching agent and fixing agent can be combined in a bleach-fixing solution and the silver removed in one step by use of such solution.

In the reversal processing of black-and-white photographic materials, a bleaching step is also utilized to remove photographically developed silver.

A wide variety of bleaching agents are known for use in photographic processing, for example, ferricyanide bleaching agents, persulfate bleaching agents, dichromate bleaching agents, permanganate bleaching agents, ferric chloride, and water-soluble quinones. A particularly important class of bleaching agents are the aminopolycarboxylic acid bleaching agents, such as an ammonium or alkali metal salt of a ferric complex of ethylenediaminetetraacetic acid (EDTA). Ferric complex salts of propylenediaminetetraacetic acid (PDTA) having a higher bleaching power than EDTA have also been widely used as bleaching agents.

Although chelants or chelating agents, such as EDTA and PDTA, are effective in the bleaching step of photographic materials, there is interest in the photography industry to obtain chelants for use in the bleaching process which biodegrade more rapidly than EDTA and PDTA. Finding suitable chelants for use in photography, which are more biodegradable than what is commonly used, is difficult as the chelant must be able to chelate the metal as well as have the proper redox ability.

Chelating ability is not indicative of redox ability of chelates of metal ions capable of more than one valence state. Nor can redox ability be predicted from structure as explained by R. Wichmann et al in "A New Bleaching Agent," presented at Imaging Science and Technology's 7th International Symposium on Photofinishing Technology, and published in R. Wichmann et al. "Advance Printing of Paper Summaries; Seventh International Symposium on Photofinishing Technology," Las Vegas, Nev. Feb. 3–5,1992 pp. 12–14. Polyamino disuccinic acids have been recognized as having some chelating properties but have not received wide usage. For instance, a better known member of the family, namely ethylenediamine disuccinic acid (EDDS), has not been widely used because it has less ability to chelate certain metal ions, such as calcium and magnesium, than more widely used chelants. The preparation of polyamino disuccinic acids is discussed by Kezerian et al. in U.S. Pat. No. 3,158,635 where their use in rust removal is disclosed. Atkinson in U.S. Pat. No. 4,704,233 disclose use of EDDS in detergents to enhance removal of organic stains and mention its biodegradability.

EP patent application 0532003, published Mar. 17, 1993, EP application 0584665 published Mar. 2, 1994, and EP application 0567126, published Oct. 27, 1993, all disclose diamine compounds which are useful in processing silver halide light-sensitive photographic material. These compounds are reported to have improved biodegradability and safety. EP patent application 0599620, published Jun. 1, 1994, further discloses monoamine and polyamine compounds which can be used in processing silver halide-photographic light-sensitive material and are reported to have good degradation characteristics. The uses of polyamino disuccinic acid chelating compounds for use in photographic bleach and bleach fixing solutions is further disclosed in WO 94/28464 published May 20, 1994.

It would be desirable to have a chelant, or a mixture of chelants, useful in photographic processes, particularly as a bleaching agent, when such chelant or mixture of chelants is greater than about 60 percent biodegradable within less than 28 days according to the OECD 301B "Ready Biodegradability: Modified Sturm Test". This test measures the $CO_2$ produced by the test compound or standard, which is used as the sole carbon source for the microorganisms.

SUMMARY OF THE INVENTION

A mixture of metal chelates of a polyamino disuccinic acid and a polyamino monosuccinic acid and/or a monoamino monosuccinic acid have been found to be an excellent oxidizing agent for use in photographic bleach and bleach-fixing solutions for the bleaching of photographic materials containing a silver halide.

In one aspect the invention includes a method of bleaching or bleach-fixing a developed silver halide photographic material comprising contacting said color photographic material with a bleaching solution containing a bleaching agent comprising at least two compounds selected from a metal complex of a polyamino disuccinic acid, a metal complex of a polyamino monosuccinic acid, or a metal complex of a monoamino monosuccinic acid, the metal being selected from Fe(III), Mn(III), Co(III) and Cu(II). Additionally, the invention includes an aqueous photographic bleaching solution comprising a rehalogenating agent and as the bleaching agent at least two compounds selected from a metal complex of a polyamino disuccinic acid, a metal complex of a polyamino monosuccinic acid, or a metal complex of a monoamino monosuccinic acid.

DETAILED DESCRIPTION OF THE INVENTION

The present invention is to the use of a mixture of at least one polyamino disuccinic acid and at least one compound selected from a polyamino monosuccinic acid, or a monoamine monosuccinic acid in bleaching or bleach-fixing solutions used in photographic applications. It has been unexpectedly found that when a mixture of such compounds is used to chelate a metal ion, such as iron, manganese, cobalt, or copper, such mixtures show a greater ability to chelate the metal ion and such complexes have a greater stability than what would be expected from the sum of the individual compounds. Such mixtures also show an increase in biodegradability as measured by the OECD 301B "Ready Biodegradability: Modified Sturm Test". The metal chelate mixtures thus serve as excellent oxidizing agents for use in photographic bleaching and bleach-fixing solutions for the bleaching of photographic silver.

Polyamino disuccinic acids are compounds having two or more nitrogen atoms wherein 2 of the nitrogens are bonded to a succinic acid (or salt) group, preferably only two nitrogen atoms each have one succinic acid (or salt) group attached thereto. The compound has at least 2 nitrogen atoms, and due to the commercial availability of the amine, preferably has no more than about 10 nitrogen atoms, more preferably no more than about 6, most preferably 2 nitrogen atoms. Preferably no more than about 4 nitrogen atoms, more preferably no more than about 3, most preferably 2 nitrogen atoms are substituted with succinic acid groups. Remaining nitrogen atoms most preferably are substituted with hydrogen atoms. More preferably, the succinic acid groups are on terminal nitrogen atoms, most preferably each of which nitrogens also has a hydrogen substituent. Because of steric hindrance of two succinic groups on one nitrogen, it is preferred that each nitrogen having a succinic group has only one such group. Remaining bonds on nitrogens having a succinic acid group are preferably filled by hydrogens or alkyl or alkylene groups (linear, branched or cyclic including cyclic structures joining more than one nitrogen atom or more than one bond of a single nitrogen atom, preferably linear) or such groups having ether or thioether linkages, all of preferably from 1 to about 10 carbon atoms, more preferably from 1 to about 6, most preferably from 1 to about 3 carbon atoms, but most preferably hydrogen. More preferably, the nitrogen atoms are linked by alkylene groups, preferably each of from about 2 to about 12 carbon atoms, more preferably from about 2 to about 10 carbon atoms, even more preferably from about 2 to about 8, most preferably from about 2 to about 6 carbon atoms. The polyamino disuccinic acid compound preferably has at least about 10 carbon atoms and preferably has at most about 50, more preferably at most about 40, most preferably at most about 30 carbon atoms. The term "succinic acid" is used herein for the acid and salts thereof; the salts include metal cation (e.g. potassium, sodium) and ammonium or amine salts. Polyamino disuccinic acids useful in the practice of the invention are unsubstituted (preferably) or inertly substituted, that is substituted with groups that do not undesirably interfere with the activity of the polyamino disuccinic acid in a selected application, particularly photographic uses. Such inert substituents include alkyl groups (preferably of from 1 to about 6 carbon atoms); aryl groups including arylalkyl and alkylaryl groups (preferably of from 6 to about 12 carbon atoms), and the like with alkyl groups preferred among these and methyl and ethyl groups preferred among alkyl groups. Inert substituents are suitably on any portion of the molecule, preferably on carbon atoms, more preferably on alkylene groups, e.g. alkylene groups between nitrogen atoms or between carboxylic acid groups, most preferably on alkylene groups between nitrogen groups.

Preferred polyamino disuccinic acids include ethylenediamine-N,N'-disuccinic acid, diethylenetriamine-N,N"-disuccinic acid, triethylenetetraamine-N,N'"-disuccinic acid, 1,6-hexamethylenediamine N,N'-disuccinic acid, tetraethylenepentamine-N,N""-disuccinic acid, 2-hydroxypropylene-1,3-diamine-N,N'-disuccinic acid, 1,2-propylenediamine-N,N'-disuccinic acid, 1,3-propylenediamine-N,N'-disuccinic acid, cis-cyclohexanediamine-N,N'-disuccinic acid, trans-cyclohexanediamine-N,N'-disuccinic acid, and ethylenebis (oxyethylenenitrilo)-N,N'-disuccinic acid. The preferred polyamino disuccinic acid is ethylenediamine-N,N'-disuccinic acid.

Such polyamino disuccinic acids can be prepared, for instance, by the process disclosed by Kezerian et al. in U.S. Pat. No. 3,158,635 which is incorporated herein by reference in its entirety. Kezerian et al disclose reacting maleic anhydride (or ester or salt) with a polyamine corresponding to the desired polyamino disuccinic acid under alkaline conditions. The reaction yields a number of optical isomers, for example, the reaction of ethylenediamine with maleic anhydride yields a mixture of three optical isomers [R,R], [S,S] and [S,R] ethylenediamine disuccinic acid (EDDS) because there are two asymmetric carbon atoms in ethylenediamine disuccinic acid. These mixtures are used as mixtures or alternatively separated by means within the state of the art to obtain the desired isomer(s). Alternatively, [S,S] isomers are prepared by reaction of such acids as L-aspartic acid with such compounds as 1,2-dibromoethane as described by Neal and Rose, "Stereospecific Ligands and Their Complexes of Ethylenediaminedisuccinic Acid", *Inorganic Chemistry*, v. 7. (1968), pp. 2405–2412.

Polyamino monosuccinic acids are compounds having at least two nitrogen atoms to which a succinic acid (or salt) moiety is attached to one of the nitrogen atoms. Preferably the compound has at least 2 nitrogen atoms, and due to the commercial availability of the amine, preferably has no more than about 10 nitrogen atoms, more preferably no more than about 6, most preferably 2 nitrogen atoms. Remaining nitrogens atoms, those which do not have a succinic acid moiety attached, preferably are substituted with hydrogen atoms. Although the succinic acid moiety may be attached to any of the amines, preferably the succinic acid group is attached to a terminal nitrogen atom. By terminal it is meant the first or last amine which is present in the compound, irrespective of other substituents. The remaining bonds on the nitrogen having a succinic acid group are preferably filled by hydrogens or alkyl or alkylene groups (linear, branched or cyclic including cyclic structures joining more than one nitrogen atom or more than one bond of a single nitrogen atom, preferably linear) or such groups having ether or thioether linkages, all of preferably from 1 to about 10 carbon atoms, more preferably from 1 to about 6, most preferably from 1 to about 3 carbon atoms, but most preferably hydrogen. Generally the nitrogen atoms are linked by alkylene groups, each of from about 2 to about 12 carbon atoms, preferably from about 2 to about 10 carbon atoms, more preferably from about 2 to about 8, and most preferably from about 2 to about 6 carbon atoms. The polyamino monosuccinic acid compound preferably has at least about 6 carbon atoms and preferably has at most about 50, more preferably at most about 40, and most preferably at most about 30 carbon atoms. Polyamino monosuccinic acids useful in the practice of the invention are unsubstituted (preferably) or inertly substituted as described above for polyamino disuccinic acid compounds.

Preferred polyamino monosuccinic acids include ethylenediamine monosuccinic acid, diethylenetriamine monosuccinic acid, triethylenetetraamine monosuccinic acid, 1,6-hexamethylenediamine monosuccinic acid, tetraethylenepentamine monosuccinic acid, 2-hydroxypropylene-1,3-diamine monosuccinic acid, 1,2-propylenediamine monosuccinic acid, 1,3-propylenediamine monosuccinic acid, cis-cyclohexanediamine monosuccinic acid, trans-cyclohexanediamine monosuccinic acid and ethylenebis (oxyethylenenitrilo) monosuccinic acid. The preferred polyamino monosuccinic acid is ethylenediamine monosuccinic acid.

Such polyamino monosuccinic acids can be prepared for instance, by the process of Bersworth et al. in U.S. Pat. No. 2,761,874, the disclosure of which is incorporated herein by reference, and as disclosed in Jpn. Kokai Tokkyo Koho JP 57,116,031. In general, Bersworth et al. disclose reacting alkylene diamines and dialkylene triamines under mild conditions with maleic acid esters (in an alcohol) to yield amino derivatives of N-alkyl substituted aspartic acid. The reaction yields a mixture of the R and S isomers.

Monoamino monosuccinic acid compounds used in the present invention are compounds containing a single nitrogen atom to which a succinic acid moiety, or salt thereof, is attached. The remaining bonds on the nitrogen atom can be a carboxy $C_1$–$C_3$ alkyl, hydroxy $C_2$–$C_4$ alkyl, hydrogen, phosphono or sulfo $C_1$–$C_4$ alkyl. Representative monoamino monosuccinic acid compounds and their preparation are given in EP patent application 0591934 published Apr. 13, 1994, the disclosure of which is incorporated herein by reference. Monoamino monosuccinic acids can also be prepared by reacting the appropriate monoamine with maleic acid and calcium hydroxide under alkaline conditions as taught in British Patent Specification 1,389,732 published Apr. 9, 1975.

In a preferred embodiment, when the bleach solution contains a mixture of a polyamino disuccinic acid and a polyamino monosuccinic acid, it is preferred that the polyamino substituent of the poyamino disuccinic acid and the polyamino monosuccinic acid are the same. Thus by way of example, if the polyamino disuccinic acid is ethylenediamine-N-N'-disuccinic acid, the polyamine monosuccinic acid is ethylenediamine monosuccinic acid.

Metal complexes of compounds used in the present invention are conveniently formed by mixing a metal compound with an aqueous solution of the succinic acid (or salt) compounds. The pH of the resulting metal chelate solutions are preferably adjusted with an alkaline material such as ammonia solution, sodium carbonate, or dilute caustic (NaOH). Water soluble metal compounds are conveniently used. Exemplary metal compounds include the metal nitrate, sulfate, and chloride. The final pH of the metal chelate solutions are preferably in the range of about 4 to 9, more preferably in the range of about 5 to 8. When an insoluble metal source is used, such as the metal oxide, then the succinic acid compounds are preferably heated with the metal oxide in an aqueous medium at an acidic pH. The use of ammoniated amino succinic acid solutions are particularly effective. Ammoniated amino succinic acid chelants are conveniently formed by combining aqueous ammonia solutions and aqueous solutions or slurries of amino succinic acids in the acid (rather than salt) form.

Mixtures of the succinic acid compounds are preferably employed in the form of water-soluble salts, notably alkali metal salts, ammonium salts, or alkyl ammonium salts. The alkali metal salts can involve one or a mixture of alkali metal salts although the potassium or sodium salts, especially the partial or complete sodium salts of the acids are preferred because of their relatively low cost and enhanced effectiveness.

Mixtures of the succinic acid compounds are particularly useful in photography, especially as bleaching agents in bleach fixing solutions in the form of the metal complex. The term 'bleach' or 'bleaching' is used herein to have the customary meaning associated with this term as it relates to processing of photographic material containing a silver halide. More specifically, it is the oxidation of a silver image, e.g. image-wise exposed and developed silver to ionic silver. This conversion is an essential step in conventional reversal processing of black-and-white materials and in the processing of both color negative and color reversal materials. Bleaching can also be used in processes for intensification of the image and processes for partial oxidation of the silver image to decrease the optical density of that image.

The bleaching solutions are used to bleach a photographic material having at least one silver halide layer or component.

The photographic materials to be processed using the present invention can contain any of the conventional silver halides as the photosensitive material, for example, silver chloride, silver bromide, silver bromoiodide, silver chlorobromide, silver chloroiodide, and mixtures thereof. In one embodiment, the photographic material contains a high chloride content, containing at least 50 mole percent silver chloride and more preferably at least 90 mole percent silver chloride.

The level of silver in the element can be any amount conveniently used in the art, but is generally less than about 10 $g/m^2$. Preferably, it is less than about 2 $g/m^2$. In the case of photographic papers, the levels are preferably below 1 $g/m^2$, and more preferably, less than 0.8 $g/m^2$. Lower amounts can be used if desired.

The photographic materials processed in the practice of this invention can be single color elements or multicolor elements. Multicolor materials typically contain dye image-forming units sensitive to each of the three primary regions of the visible spectrum. Each unit can be comprised of a single emulsion layer or of multiple emulsion layers sensitive to a given region of the spectrum. The layers of the element, including the layers of the image-forming units, can be arranged in various orders as known in the art. In an alternative format, the emulsions sensitive to each of the three primary regions of the spectrum can be disposed as a single segmented layer. The element can contain additional layers such as filter layers, interlayers, overcoat layers, subbing layers and the like as is well known in the art. The element may also contain a magnetic backing such as is also known in the art.

Considerably more details of photographic elements of many varieties are provided in the *Research Disclosure*, page 501, No. 36544 (1994) the disclosure of which is incorporated herein by reference. Such details relate, for example, to useful silver halide emulsions (either negative-working or positive-working) and their preparation, color-forming couplers, color developing agents and solutions, brighteners, antifoggants, image dye stabilizers, hardeners, plasticizers, lubricants, matting agents, paper and film supports, and the various image-formation processes for both negative-image-and positive-image forming color elements.

The photographic elements can be imagewise-exposed with various forms of energy which encompass the ultraviolet and visible and infrared regions of the electromagnetic spectrum, as well as electron-beam and beta radiation, gamma ray, X-ray, alpha particle, neutron radiation and other forms of corpuscular and wave-like radiant energy in either noncoherent (random phase) forms or coherent (in phase) forms as produced by lasers. The conditions under which the photographic elements are imagewise-exposed are well known to those of ordinary skill in the art.

The succinic acid compounds used as bleaching agents which are components of the bleaching compositions and bleach-fixing compositions of this invention are preferably utilized in the form of water-soluble salts, such as ammonium or alkali metal salts, of a metal amino succinic acid complex. Alternatively, the metal complexes of the present invention are used as free acid (hydrogen), alkali metal salt such as sodium salt, potassium salt, lithium salt, or ammonium salt, or a water soluble amine salt such as triethanolamine salt. Preferably, the potassium salt, sodium salt or ammonium salt is used. It is optional to use the metal complexes in combination with one more aminopolycarboxylic compounds.

The amount of the succinic acid compounds to be used depends on the amount of silver and the silver halide composition in the light-sensitive material to be processed. It is preferred to employ about 0.01 mole or more, more preferably about 0.05 to about 1.0 mole, per liter of solution employed; preferably there is a molar ratio of succinic acid compounds to metal ion of from about 1:1 to about 5:1. In a supplemental solution, for supplying a smaller amount of more concentrated solution, such as a replenishment solution or regenerator solution used in photographic processing, the solution is conveniently employed at the maximum concentration permitted by the solubility of the succinic acid compounds. The bleach compositions of this invention preferably contain about 5 to about 400 grams per liter of the succinic acid compound bleaching agents, more preferably about 10 to about 200 grams per liter.

The processing solutions having bleaching ability include both bleach solutions and bleach-fixing solutions. These solutions accordingly contain a metal complex salt of the succinic acid compounds used as a bleaching agent and are operated in a pH range from about 2 to about 8, more preferably about 3.5 to 7.5, most preferably about 4.0 to 6.5. The temperature for processing is lower than 80° C., more desirably between about 35° C. and 65° C. to suppress evaporation. The processing time for bleaching is 10 seconds to four minutes and preferably 15 seconds to 3 minutes.

The bleach or bleach-fix compositions optionally contain other additives within the skill in the art, such as amines, sulfites, mercaptotriazoles, alkali metal bromides, alkali metal iodides, thiols and the like. An additional silver halide solvent such as water-soluble thiocyanate or potassium thiocyanate is optionally included in the bleach-fix compositions. The bleach or bleach-fix compositions optionally contain uncomplexed chelating agent.

Other additives which can contribute to bleach-fixing characteristics, include alkali metal halides or ammonium halides, such as potassium bromide, sodium bromide, sodium chloride, ammonium bromide, ammonium iodide, sodium iodide, potassium iodide, and the like. Other optional additives include solubilizing agents such as triethanolamine, acetylacetone, phosphonocarboxylic acid, polyphosphoric acid, organic phosphonic acid, oxycarboxylic acid, polycarboxylic acid, alkylamines, polyethyleneoxides and the like within the skill in the art for use in bleaching solutions.

Use of special bleach-fixing solutions such as a bleach fixing solution comprising a composition in which a halide such as potassium bromide is added in a small amount, or alternatively a bleach-fixing solution in which a halide such as potassium bromide, ammonium bromide and/or ammonium iodide, or potassium iodide is added in a large amount, and, in addition, a bleach-fixing solution with a composition comprising a combination of the bleaching agent of the present invention and a large amount of a halide such as potassium bromide is within the scope of the invention.

Silver halide fixing agents suitable for incorporation in the bleach-fixing solutions of the present invention are preferably compounds within the skill in the art for fixing processing which can react with a silver halide to form a water soluble complex, and include thiosulfates such as potassium thiosulfate, sodium thiosulfate, ammonium thiosulfate, and the like; thiocyanates such as potassium thiocyanate, sodium thiocyanate, ammonium thiocyanate, thiourea, thioether; highly concentrated bromides, iodides, and the like. These fixing agents are conveniently used in amounts within the range which can be dissolved, namely 5 g/liter or more, preferably 50 g/liter or more, more preferably 70 g/liter or more; more preferably there are less than about 400, most preferably less than about 200 grams per liter. The fixing or bleach-fixing solutions may contain one or more substances which can accelerate fixing. Some of these materials are described in Chapter 15 of "The Theory of the Photographic Process," 4th edition, T. H. James, ed., Macmillan, N.Y., 1977. Such substances include ammonium salts such as ammonium chloride, amines such as ethylenediamine and guanidine, thiourea, and thioether compounds such as 3,6-dithia-1,8-octanediol.

The bleach-fixing solutions of the present invention optionally also contain various pH buffers such as boric acid, borax, sodium hydroxide, potassium hydroxide, sodium carbonate, potassium carbonate, sodium bicarbonate, acetic acid, sodium acetate, ammonium hydroxide, other substituted and unsubstituted carboxylic acids, substituted and unsubstituted dicarboxylic acids such as maleic acid or succinic acid or their salts and the like either singly or in a combination of two or more compounds. Optional ingredients include various fluorescent whitening agents, defoaming agents, antifungal agents, preservatives such as hydroxylamine, hydrazine, sulfites, metabisulfites, bisulfite adducts of aldehyde or ketone compounds, or other additives. Particularly useful hydroxylamines include substituted or unsubstituted dialkylhydroxylamines including, but not limited to, those described in U.S. Pat. Nos. 5,354,646 and 4,876,174. Representative useful hydroxylamine antioxidants are bis(sulfonatoethyl)hydroxylamine and N-isopropyl-N-sulfonatoethylhydroxylamine. Organic solvents such as methanol, dimethylformamide, dimethyl sulfoxide, and the like are optionally included. Addition of a polymer or a copolymer having a vinyl pyrrolidone nucleus as disclosed in Japanese Provisional Patent Publication No. 10303/1985 is also within the scope of the invention.

Other optional compounds in the bleach-fixing solution of the present invention for accelerating bleach-fixing characteristics, include tetramethylurea, phosphoric trisdimethylamide, ε-caprolactam, N-methylpyrrolidone, N-methylmorpholine, tetraethyleneglycol monophenyl ether, acetonitrile, glycol monomethyl ether, and the like.

After exposure of the photographic element to form a latent image, further processing of the element includes the step of contacting the element with a color developing agent to reduce developable silver halide and to oxidize the color developing agent. Oxidized color developing agent in turn reacts with the coupler to yield a dye. Color developer solutions are well known in the art, and contain various additives besides the color developing agent. Antioxidants are usually included, for example, the hydroxylamines described above (such as substituted or unsubstituted monoalkyl or dialkylhydroxylamines).

With negative working silver halide, the processing step gives a negative image. To obtain a positive (or reversal) image, this step can be preceded by development with a non-chromogenic developing agent to develop exposed silver halide, but not form dye, and then uniformly fogging the element to render unexposed silver halide developable. Alternatively, a direct positive emulsion can be employed to obtain a positive image.

Development is followed by the conventional steps of bleaching and fixing to remove silver and silver halide, washing and drying.

In some cases, a separate pH lowering solution, referred to as a stop bath, is employed to terminate development prior to bleaching. A stabilizer bath is commonly employed for final washing and hardening of the bleached and fixed photographic element prior to drying.

Representative examples of preferable processing methods, particularly color negative films and color print papers, may include the various steps as shown below:

(1) Color developing→Bleach-fixing→Water washing
(2) Color developing→Bleach-fixing→Washing with a small amount of water→Water washing
(3) Color developing→Bleach-fixing→Water washing→Stabilizing
(4) Color developing→Bleach-fixing→Stabilizing
(5) Color developing→Bleach-fixing→First Stabilizing→Second Stabilizing
(6) Color developing→Water washing (or stabilizing) →Bleach-fixing→Water washing (or stabilizing)
(7) Color developing→Pre-fixing→Bleach-fixing→Water washing
(8) Color developing→Pre-fixing→Bleach-fixing→Stabilizing
(9) Color developing→Pre-fixing→Bleach-fixing→First stabilizing→Second stabilizing
(10) Color developing→Stopping→Bleach-fixing→Water washing→Stabilizing.
(11) Color developing→Bleaching→Bleach-fixing→Water washing
(12) Color developing→Bleaching→Fixing→Water washing→Stabilizing
(13) Color developing→Bleaching→Fixing→Stabilizing
(14) Color developing→Bleaching→Fixing→Water washing→Stabilizing
(15) Color developing→Bleaching→Rinsing→Fixing→Washing→Stabilizing
(16) Color developing→Bleaching→Bleach-fixing→Fixing→Stabilizing Of these processing steps, those of (3), (4), (5), (8), (9) and (16) are preferably employed in the present invention, with processing steps of (4), (5), (8), (9) and (16) most preferred.

For color reversal films representative examples of preferable processing methods may include the various steps as shown below:

(17) Non-chromogenic developing→Washing→Reversal bath→Color developing→Bleach conditioner→Bleaching→Fixing→Washing→Stabilizer
(18) Non-chromogenic developing→Washing→Reversal bath→Color developing→Bleach conditioner/stabilizer→Bleaching→Fixing→Washing→Final rinse
(19) Non-chromogenic developing→Washing→Reversal bath→Color developing→Bleach conditioner→Bleaching→Washing→Fixing→Washing→Stabilizer
(20) Non-chromogenic developing→Washing→Light re-exposure→Color developing→Bleach conditioner→Bleaching→Fixing→Washing→Stabilizer The stabilizing solution used in the processing step can be used to stabilize dye images. Examples of such a solution include solutions having a pH of 3 to 6 with buffering ability and solutions containing an aldehyde (e.g. formalin or meta-hydroxybenzaldehyde) or an aldehyde precursor (e.g., hexamethylenetetramine). The stabilizing solution may contain a fluorescent brightening agent, chelating agent (e.g., 1-hydroxyethylidene-1,1-diphosphonic acid), biocide, antifungal agent, film hardener, surface active agent (e.g., polyethylene glycol) and alkanolamine.

In the bleach-fixing solutions of the present invention, chelating agents and/or metal complexes thereof outside the scope of the present invention are optionally added. However, it is preferred to use the metal complex outside the scope of the present invention at a proportion of 0.45 mole percent or less relative to the organic acid metal complexes of the present invention.

The reduced product of the metal complex formed in use of the bleach-fixing solution is optionally returned to the oxidized state, preferably by an oxidation treatment. Oxidation treatments include, for instance, introducing air or oxygen bubbles e.g. into the processing solution in the bleaching solution tank or the bleach-fixing solution tank, e.g., in an automatic developing machine, or by natural contact of the air on the liquid surface. For oxidation, effective contact of air or oxygen and solution is needed. Such contact is within the skill in the art and achieved by such means as stirring.

The invention will be further clarified by a consideration of the following examples, which are intended to be purely exemplary of the present invention.

EXAMPLE 1

An approximate 0.01M iron (ferric) chelate solution of ethylenediamine N,N'-disuccinic acid (EDDS) was prepared by adding 1.46 grams of EDDS (0.0050 moles) and 200 grams of deionized water to a beaker. The mixture was stirred with a magnetic stirrer bar and the pH was adjusted to approximately 8.7 by the addition of an aqueous ammonia solution. Approximately 2.3 grams of an iron nitrate solution (11.7% iron) from Shepherd Chemical Company was added with stirring. The iron chelate solution (pH=3.1) was diluted in a volumetric flask to a final volume of 500 milliliters with deionized water. Fifty gram aliquots of the above solution were then placed in 2 oz. bottles and the pH adjusted to 5.0, 6.0, 7.0, 8.0, 9.0 and 10.0 by the addition of a few drops of an aqueous ammonia solution. The samples were allowed to stand for 7 days at which time the pH 10 sample had iron hydroxide present. "Overheads" from each of the samples were filtered and analyzed for soluble iron by inductively coupled plasma spectroscopy. The results are given in Table 1.

TABLE 1

| pH | ppm Fe |
|---|---|
| 5 | 514 |
| 6 | 530 |
| 7 | 531 |
| 8 | 533 |
| 9 | 514 |
| 10 | 181 |

EXAMPLE 2

An approximate 0.01M iron chelate solution of ethylenediamine N-monosuccinic acid (EDMS) was prepared by adding 0.88 grams of EDMS 5 (0.0050 moles) and 200 grams of deionized water to a beaker. The mixture was stirred with a magnetic stirrer bar and approximately 2.3 grams of iron nitrate solution (11.7% iron) was added with stirring. The iron chelate solution (pH=2.3) was diluted in a volumetric flask to a final volume of 500 milliliters with deionized water. Fifty gram aliquots of the solution were placed in 2 oz. bottles and the pH adjusted to 5.0, 6.0, 7.0, 8.0, 9.0 and 10.0 by the addition of a few drops of an aqueous ammonia solution. The samples were allowed to stand for 7 days at which time the pH 9 and 10 samples had iron hydroxide present. "Overheads" from each of the samples were filtered and analyzed for soluble iron by inductively coupled plasma spectroscopy. The results are given in Table 2.

TABLE 2

| pH | ppm Fe |
|---|---|
| 5 | 499 |
| 6 | 501 |
| 7 | 498 |
| 8 | 507 |
| 9 | 6 |
| 10 | 1 |

EXAMPLE 3

In a similar manner to Examples 1 and 2 above, 0.01 molar iron chelate solutions were prepared from various mixtures of EDDS and EDMS. The total amount of chelating agent was held constant at 0.0050 moles. Ratios (molar) of EDDS to EDMS of 90/10, 80/20, 60/40, 40/60, 20/80 and 10/90 were prepared and 50 gram aliquots were adjusted as described earlier. The samples were allowed to stand for 7 days at which time the pH 10 samples at all ratios had iron hydroxide present. In addition, the pH 9 sample at a molar ratio of 10:90 had iron hydroxide present. "Overheads" from each of the samples were filtered and analyzed for soluble iron. The results obtained for the pH 9 samples at each of the ratios is summarized in Table 3. The "expected" value for iron in each ratio is also given as well as the results for EDDS and EDMS. A comparison of the expected ppm iron with the actual values measured demonstrates the synergistic effect obtained from the EDDS/EDMS mixtures. After an additional 17 days, the pH 9 samples at mole ratios of 20:80 and 40:60 had iron hydroxide present. A small amount of iron hydroxide was noted for the 60:40 ratio.

TABLE 3

| EDDS/EDMS Molar Ratio | ppm Fe Expected | ppm Fe Found |
|---|---|---|
| 100/0 | — | 514 |
| 90/10 | 463 | 519 |
| 80/20 | 412 | 508 |
| 60/40 | 311 | 508 |
| 40/60 | 209 | 499 |
| 20/80 | 108 | 526 |
| 10/90 | 57 | 215 |
| 0/100 | — | 6 |

EXAMPLE 4

Samples of EDMS and various isomers of EDDS were tested for biodegradability according to the OECD 301B "Ready Biodegradability: Modified Sturm Test". The test measures the $CO_2$ produced by the test compound or standard, which is used as the sole carbon source for the microbes. The following samples were tested:

a) EDMS racemic mixture
b) R,R-EDDS
c) S,S-EDDS
d) EDDS racemic mixture, approx. 25% each R,R-EDDS and S,S-EDDS, and 50% meso-EDDS
e) Sample A: contains 69.8% EDDS racemic mixture, 16.7% EDMS racemic mixture, and 13.5% fumaric acid Each compound was tested at a 20 ppm dose level (based on EDMS or EDDS component active as the acid form). Each compound is evaluated as a series comprising a test vessel, a standard vessel, and a blank vessel. The seed innoculum for each test compound series was obtained from organisms previously exposed to the respective compound in a semi-continuous activated sludge test. The total volume in the vessels was 2100 ml each. To confirm the viability of each seed innoculum, acetic acid was used as the standard at a concentration of 20 ppm in each series. A blank vessel is used to determine the inherent $CO_2$ evolved from each respective innoculum. Carbon dioxide captured in respective barium hydroxide traps was measured at various times during the 28-day test period. The cumulative results of the test are summarized in Table 4.

TABLE 4

Sturm Test Results of EDMS and EDDS Samples

| Test Compound | Theoretical mMoles $CO_2$ | Measured mMoles $CO_2$ | % Theoretical $CO_2$ Produced |
|---|---|---|---|
| EDMS | 1.43 | 1.08 | 75% |
| R,R-EDDS | 1.44 | 0.21 | 14% |
| S,S-EDDS | 1.44 | 1.03 | 72% |
| EDDS rac. mix | 1.44 | 0.43 | 30% |
| Sample A | 2.05 | 1.40 | 68% |
| Acetate Standards | 1.40 | 1.19 ± 0.12 (ave.) | 85% (ave.) |

Sample A was added to the test cell to achieve a 20 ppm level of the active EDDS in the sample. Therefore, the theorectical total of $CO_2$ possible is 1.44 mMoles $CO_2$ from 20 ppm EDDS isomers, plus the theoretical amount of $CO_2$ from EDMS (0.34 mMoles) and the theoretical amount of $CO_2$ from fumaric acid (0.27 mMoles). The total theoretical amount of $CO_2$ possible from this sample is thus 1.44 EDDS+0.34 EDMS+0.27 fumaric=2.05 mMoles $CO_2$.

Using the experimental data in Table 4, the amount of $CO_2$ that would be expected to actually be produced by Sample A can be calculated:

As shown in Table 4, the EDMS produced 75% of the theoretical $CO_2$. The theoretical amount of $CO_2$ possible from the EDMS present in Sample A is 0.34 mMoles. Thus, multiplying the theoretical amount of $CO_2$ that could be produced by the EDMS in Sample A by 75% yields an expected amount of 0.34×0.75=0.26 mMoles.

Since fumaric acid was not determined separately, it is assumed that 95% of theoretical $CO_2$ is produced (this assumes greater $CO_2$ production than the acetate standard, which is highly unlikely) as a conservative estimate. The theoretical amount of $CO_2$ possible from the fumaric acid present in Sample A is 0.27 mMoles. Thus, multiplying the theoretical amount of $CO_2$ that could be produced by the fumaric acid in Sample A by 95% yields an expected amount of 0.27×0.95=0.26 mMoles.

From Table 4, the EDDS racemic mixture produced 30% of theoretical $CO_2$. The theoretical amount of $CO_2$ from the EDDS in Sample A is 1.44 mMoles. Therefore, the expected amount of $CO_2$ produced from the EDDS portion of Sample A is 1.44×0.3=0.43 mMoles, as given in Table 4.

Adding the amounts of $CO_2$ expected from the EDMS, fumaric and EDDS in Sample A, the total amount is 0.26 mMoles $CO_2$ from EDMS +0.26 mMoles $CO_2$ from fumaric +0.43 mMoles $CO_2$ from EDDS isomers=0.95 mMoles $CO_2$. Dividing the expected amount (0.95 mMoles $CO_2$) by the theoretical amount (2.05 mMoles $CO_2$) gives an expected % theoretical $CO_2$ produced of 46%. The amount observed is a total of 68% of theoretical. These results are further summarized in Table 5.

TABLE 5

Expected vs Observed $CO_2$ Production in Sample A

| Compound in Sample A | Theoretical mMoles $CO_2$ | Expected mMoles $CO_2$ | % Theor $CO_2$ Expected |
|---|---|---|---|
| EDMS | 0.34 | 0.26 | 75% |
| fumaric acid | 0.27 | 0.26 | 95% |
| EDDS rac. mix | 1.44 | 0.43 | 30% |
| | | Predicted Total | |
| | 2.05 | 0.95 | 46% |
| | | Observed Total | |
| | 2.05 | 1.40 | 68% |

Another way to evaluate the data is to calculate the amount of $CO_2$ that would be expected from only the EDDS portion of Sample A.

From Table 5, the expected amount of $CO_2$ from the EDDS in Sample A is 0.43 mMoles, based on experimental measurements of the EDDS racemic mixture.

The expected amount of $CO_2$ from the EDMS portion of the sample is 0.26 mMoles and the expected amount of $CO_2$ from the fumaric acid portion is 0.26 mMoles. If the amounts of expected $CO_2$ from EDMS and fumaric acid are subtracted from the observed amount of $CO_2$ produced, we are left with the amount of $CO_2$ produced by the EDDS portion of the sample=1.40 mMoles (total $CO_2$ produced by Sample A)–0.26 mMoles (predicted amount of $CO_2$ produced from EDMS in Sample A)–0.26 mMoles (predicted amount of $CO_2$ produced from fumaric in Sample A)=0.88 mMoles $CO_2$ produced by the EDDS portion of Sample A.

The theoretical amount of $CO_2$ possible from the EDDS portion of Sample A is 1.44 mMoles $CO_2$. Therefore, the predicted (and experimentally measured) % theoretical $CO_2$ produced is 0.43 mMoles divided by 1.44 mMoles=30%. In these tests, the observed % theoretical $CO_2$ produced calculated for the EDDS portion of Sample A is 0.88 mMoles. Dividing 0.88 mMoles by the theoretical 1.44 mMoles=61% theoretical $CO_2$ produced by the EDDS portion of Sample A. A value of greater than 60% of the theoretical amount of $CO_2$produced in this test indicates that a compound is readily biodegradable. The experimentally measured value for the EDDS portion of Sample A is 30%.

The data for the EDDS portion of Sample A indicates that from a biodegradability standpoint, it appears to be an advantage to have a mixture of EDDS and EDMS vs EDDS alone. Table 6 summarizes the above calculations.

TABLE 6

Expected vs Observed $CO_2$ Produced from EDDS in Sample A

| | mMoles $CO_2$ | % of Theoretical $CO_2$ |
|---|---|---|
| Predicted amount $CO_2$ expected from EDDS portion of Sample A | 0.43 | 30% |
| "Observed" amount of $CO_2$ produced from EDDS portion of Sample A | 0.88 | 61% (from EDDS only) |

EXAMPLE 5

Bleach-Fixing in a Flow Cell

Samples of KODAK DURACLEAR™ transparency film were given a flash exposure (2 sec, 3000K lamp) then developed and fixed (but not bleached) at 37.7 degrees C. using conventional color paper processing solutions, using the following protocol:

| | |
|---|---|
| 120 seconds | Developer bath |
| 60 seconds | 3% acetic acid stop bath |
| 60 seconds | water wash |
| 240 seconds | Fixing bath |
| 180 seconds | water wash |
| 60 seconds | rinse bath |

The film samples were air-dried. To measure a rate of bleaching, a 1.3 $cm^2$ round piece was cut from the film sample and placed in a flow cell. This cell, 1 cm×1 cm×2 cm, was constructed to hold the round film sample in the light path of a diode-array spectrophotometer, enabling light absorption of the round film to be measured while processing solution was circulated over the sample piece. Both the processing solution, 50 ml, and the flow cell were held at a constant temperature of 25 degrees C. Three hundred absorbance measurements at 81 0 nm were collected at 2 second intervals over a 600-second period of time. The absorbance was plotted as a function of time, and the time required for 50% bleaching was determined graphically. Control experiments indicated that this flow cell method is an excellent predictor of bleaching rates in a standard process run at 37.7 degrees C.

The resulting bleach-fixing rates at pH 6.0 using the following bleach-fixing processing solution composition are presented in Table 7.

| Bleach-fixing solution composition | |
|---|---|
| Ferric Nitrate | 0.025 mol/L |
| Ammonium nitrate | 0.96 mol/L |
| Ammonium thiosulfate | 0.21 mol/L |
| Ammonium sulfite | 0.018 mol/L |
| Iron complexing ligand | (see Table 7) |

pH 6.0 adjusted with ammonium hydroxide

TABLE 7

| LIGAND | MOL RATIO TO IRON | TIME FOR 50% BLEACHING(S) |
|---|---|---|
| EDMS | 1.1 | 140 |
| EDMS | 2.2 | 122 |
| EDDS | 1.1 | 77 |
| EDDS/EDMS | 1.1/0.16 | 82 |
| EDDS/EDMS | 0.95/0.15 | 95 |
| EDDS/EDMS | 1.1/0.55 | 81 |
| EDDS/EDMS | 1.1/1.1 | 78 |

It is clear from the results in Table 7 that the ligand mixtures of the invention bleach silver as rapidly as does EDDS by itself.

EXAMPLE 6

Bleach-Fixing Rates of Silver Removal

Sample strips of KODAK DURACLEAR™ film and sample strips of Kodak B&W Motion Picture Film (5302) were flash exposed (5 sec, 3000K light), then developed and fixed, but not bleached, using a conventional color process and a black and white process, respectively.

A sample strip of each film type was bleached in a bleach-fix processing solution at pH 6.2 for times of 0, 30, 60, 90, 120, 150, 180, 210, 240, 270 and 300 seconds, then removed from the solution, washed in water and dried. The infra-red density (1000 nm) for each bleaching time is plotted against the square root of time. A straight line is drawn through the points and extrapolated to zero density. The square root of the time at zero density is squared to obtain the clear time for silver removal in Table 8. The bleach-fix composition used to process both film-types is as follows:

| | |
|---|---|
| Ferric nitrate | 0.111M |
| Ligand | (see Table 8) |
| Glacial acetic acid | 10 ml/L |
| Ammonium thiosulfate | 0.42M |
| Ammonium sulfite | 0.1M |

The ratios of iron-complexing ligand to ferric ion are also provided in Table 8.

TABLE 8

| | MOL RATIO | Clear Time (seconds) | |
|---|---|---|---|
| LIGAND | TO Fe | DURACLEAR | 5302 |
| EDMS | 1.1 | 220 | 316 |
| EDMS | 2.1 | 207 | 267 |
| EDDS | 1.1 | 155 (Ave of 2) | 237 (Ave of 2) |
| EDDS/EDMS | 1.0/0.1 | 136 | 212 |
| EDDS/EDMS | 0.9/0.2 | 170 | 244 |

TABLE 8-continued

| | MOL RATIO | Clear Time (seconds) | |
|---|---|---|---|
| LIGAND | TO Fe | DURACLEAR | 5302 |
| EDDS/EDMS | 0.8/0.3 | 154 | 224 |
| EDDS/EDMS | 1.0/0.1* | 171 | 244 |

*Replaced acetic acid with fumaric acid

The results in Table 8 show that the ferric complex salt of both EDDS and EDMS rapidly remove silver from each type of film moreover, mixtures of the two ligands form ferric complex salts that also rapidly bleach silver from these films. Replacing acetic acid with fumaric acid has no substantial impact on the silver removal rate.

EXAMPLE 7

Rehalogenating Bleaching Rates of Silver Removal

Sample strips of four commercial color negative films were flash exposed (0.01 sec, 3000K light) then developed and fixed, but not bleached, using a conventional color negative process. The film strips were air dried.

To measure bleaching rate, a 1.3 $cm^2$ round piece was cut from each film sample and placed as a window in a flow cell. This cell, 1 cm×1 cm×2 cm, was constructed to hold the round film sample in the light path of a diode array spectrophotometer, enabling light absorption of the film to be measured while processing solution was circulated over the sample piece. Both the processing solution solution, 60 mL, and the flow cell were held at a constant temperature of 25 degrees C. Three hundred absorbance measurements at 810 nm were collected at either 2-second or 4-second intervals over a 600- or 1200-second time period, respectively. The absorbance was plotted as a function of time, and the time required for 50% bleaching was determined graphically from the absorbance change. Control experiments indicated that this flow method is an excellent predictor of bleaching rates in a standard process run at 37.7 degrees C.

The resulting bleaching rates at pH 5, using the following processing solution composition, are presented in Table 9 for the four films.

| | |
|---|---|
| Ferric nitrate | 0.1 mol/L |
| Potassium bromide | 0.47 mol/L |
| Glacial acetic acid | 30 ml/L |
| Iron complexing ligand | See Table 9 |

TABLE 9

| LIGAND | MOL RATIO TO Fe | TIME FOR 50% BLEACHING (s) | | | |
|---|---|---|---|---|---|
| | | FILM 1 | FILM 2 | FILM 3 | FILM 4 |
| EDDS | 1.1 | 204 | 196 | 278 | 208 |
| EDDS/EDMS | 0.9/0.2 | 172 | 176 | 270 | 184 |
| EDDS/EDMS | 0.8/0.3 | 176 | 163 | 228 | 187 |
| EDDS/EDMS | 0.55/0.55 | 135 | 146 | 219 | 141 |
| EDMS | 1.1 | 94 | 92 | 164 | 109 |

FILM 1 = Kodak GOLD 100 Plus ™ ; FILM 2 = Kodak FUNTIME 200 ™ ; FILM 3 = Kodak ROYAL GOLD 1000 ™ ; FILM 4 = Kodak ULTRA 100 ™

It is clear from the results in Table 9 that the ligand mixtures of the invention bleach silver rapidly in a rehalogenating processing solution.

Other embodiments of the invention will be apparent to those skilled in the art from a consideration of this specification or practice of the invention disclosed herein. It is intended that the specification and examples be considered as exemplary only, with the true scope and spirit of the invention being indicated by the following claims.

What is claimed is:

1. A method of bleaching or bleach-fixing a developed silver halide photographic material comprising contacting said photographic material with a bleaching solution containing a bleaching agent comprising at least one metal complex of a polyamino disuccinic acid and one or more metal complexes of a polyamino monosuccinic acid, wherein the polyamino substituent of the at least one metal complex of a polyamino disuccinic acid and the polyamino substituent of the at least one metal complex of a polyamino monosuccinic acid are the same.

2. The method of claim 1 wherein said photographic material comprises a magnetic recording layer.

3. The method of claim 1 wherein the polyamino disuccinic acid has two or more nitrogen atoms wherein two of the nitrogens are bonded to a succinic acid or salt group thereof and said polyamino disuccinic acid has from 10 to 50 carbon atoms which are unsubstituted or substituted with an alkyl group containing 1 to 6 carbon atoms, or an arylalkyl group or alkylaryl group containing 6 to 12 carbon atoms.

4. The method of claim 3 wherein the polyamino disuccinic acid has from 2 to 6 nitrogen atoms, the nitrogen atoms being separated by alkylene groups of from 2 to 12 carbon atoms each.

5. The method of claim 4 wherein the polyamino disuccinic acid has only two nitrogens to which succinic acid or salt groups thereof are attached, which nitrogens are also bonded to at least one alkylene group and have their remaining valence filled with hydrogen, alkyl or alkylene groups.

6. The method of claim 5 wherein, in the polyamino disuccinic acid, the two nitrogens to which succinic acid or salt groups thereof are attached also have hydrogen as one substituent thereon.

7. The method of claim 6 wherein the polyamino disuccinic acid is selected from ethylenediamine-N-N'-disuccinic acid, diethylenetriamine-N-N"-disuccinic acid, triethylenetetraamine-N-N'"-disuccinic acid, 1,6-hexamethylenediamine-N-N'-disuccinic acid, tetraethylenepentamine-N-N""-disuccinic acid, 2-hydroxypropylene-1,3-diamine-N-N'-disuccinic acid, 1,2-propylenediamine-N-N'-disuccinic acid, 1,3-propylenediamine-N-N'-disuccinic acid, cis-cyclohexanediamine-N-N'-disuccinic acid, trans-cyclohexanediamine-N-N'-disuccinic acid, ethylenebis (oxyethylenenitrilo)-N-N'-disuccinic acid, and combinations thereof.

8. The method of claim 7 wherein the polyamino disuccinic acid is ethylenediamine-N,N'-disuccinic acid.

9. The method of claim 8 wherein the ethylenediamine-N,N'-disuccinic acid is the S,S isomer.

10. The method of claim 1 wherein the bleaching solution comprises a ferric complex of a polyamino disuccinic acid and a ferric complex of a polyamino monosuccinic acid.

11. The method of claim 10 wherein the polyamino disuccinic acid has two or more nitrogen atoms wherein two of the nitrogens are bonded to a succinic acid or salt group thereof and said polyamino disuccinic acid has from 10 to 50 carbon atoms which are unsubstituted or substituted with an alkyl group containing 1 to 6 carbon atoms, or an arylalkyl group or alkylaryl group containing 6 to 12 carbon atoms.

12. The method of claim 11 wherein the polyamino disuccinic acid has from 2 to 6 nitrogen atoms, the nitrogen atoms being separated by alkylene groups of from 2 to 12 carbon atoms each.

13. The method of claim 12 wherein the polyamino disuccinic acid has only two nitrogens to which succinic acid or salt groups thereof are attached, which nitrogens are also bonded to at least one alkylene group and have their remaining valence filled with hydrogen, alkyl or alkylene groups.

14. The method of claim 13 wherein, in the polyamino disuccinic acid, the two nitrogens to which succinic acid or salt groups thereof are attached also have hydrogen as one substituent thereon.

15. The method of claim 14 wherein the polyamino disuccinic acid is selected from ethylenediamine-N-N'-disuccinic acid, diethylenetriamine-N-N"-disuccinic acid, triethylenetetraamine-N-N'"-disuccinic acid, 1,6-hexamethylenediamine-N-N'-disuccinic acid, tetraethylenepentamine-N-N""-disuccinic acid, 2-hydroxypropylene-1,3-diamine-N-N'-disuccinic acid, 1,2-propylenediamine-N-N'-disuccinic acid, 1,3-propylenediamine-N-N'-disuccinic acid, cis-cyclohexanediamine-N-N'-disuccinic acid, trans-cyclohexanediamine-N-N'-disuccinic acid, ethylenebis (oxyethylenenitrilo)-N-N'-disuccinic acid, and combinations thereof.

16. The method of claim 15 wherein the polyamino disuccinic acid is ethylenediamine-N,N'-disuccinic acid.

17. The method of claim 16 wherein the ethylenediamine-N,N'-disuccinic acid is the S,S isomer.

18. The method of claim 1 wherein the metal in the metal complex is selected from iron, manganese, cobalt and copper.

19. The method of claim 18 wherein the metal is iron.

20. The method of claim 1 wherein the photographic material has been color developed before bleaching or bleach-fixing.

21. The method of claim 1 wherein said photographic material has a total silver coverage of less than or equal to 1 $g/m^2$.

22. The method of claim 1 wherein said photographic material has been color developed using a color developing solution comprising a color developing agent and a substituted or unsubstituted monoalkyl or dialkylhydroxylamine.

23. The method of claim 1 wherein the polyamino disuccinic acid and polyamino monosuccinic acid each have two nitrogens.

24. The method of claim 23 wherein the polyamino disuccinic acid is ethylenediamine-N,N'-disuccinic acid and the polyamino monosuccinic is ethylenediamine monosuccinic acid.

25. The method of claim 24 wherein the ethylenediamine-N,N'-disuccinic acid is the S,S isomer.

26. The method of claim 25 wherein the ethylenediamine monosuccinic acid is the S isomer.

27. The method of claim 10 wherein the molar ratio of the polyamino disuccinic acid to the polyamino monosuccinic acid is from 99:1 to 5:95.

28. The method of claim 1 wherein the bleaching agents are present in an amount of from 0.05 to 1 mole per liter of solution.

29. The method of claim 28 wherein the bleaching or bleach-fixing solution additionally contains a water-soluble rehalogenating agent.

30. The method of claim 29 wherein the rehalogenating agent is potassium bromide.

31. The method of claim 30 wherein the bleaching solution has a pH of from 2 to 10.

32. The method of claim 31 wherein the bleaching solution additionally contains a silver halide solvent.

33. The method of claim 32 wherein the silver halide solvent is an ammonium or alkali metal thiosulfate.

34. The method of claim 33 wherein there is sufficient concentration of the silver halide solvent to act as a fixing agent.

35. The method of claim 29 wherein the rehalogenating agent is present in said bleaching or bleach-fixing solution in an amount of at least 15 g/liter.

36. An aqueous photographic bleaching solution comprising a water-soluble halide and as the bleaching agent, a metal complex of a polyamino disuccinic acid, and a metal complex of a polyamino monosuccinic acid, wherein the polyamino substituent of the polyamino disuccinic acid and the polyamino substituent of the polyamino monosuccinic acid are the same.

37. The solution of claim 36 wherein said bleaching agents are present in a total amount of from 0.05 to 1 mol/l.

38. The solution of claim 36 comprising a ferric complex of a polyamino disuccinic acid and a ferric complex of a polyamino monosuccinic acid.

39. The solution of claim 36 wherein the molar ratio of said polyamino disuccinic acid to said polyamino monosuccinic acid is from 99:1 to 5:95.

40. The solution of claim 36 wherein said polyamino disuccinic acid is ethylenediamine-N-N'-disuccinic acid, diethylenetriamine-N-N"-disuccinic acid, triethylenetetraamine-N-N"'-disuccinic acid, 1,6-hexamethylenediamine-N-N'-disuccinic acid, tetraethylenepentamine-N-N""-disuccinic acid, 2-hydroxypropylene-1,3-diamine-N-N'-disuccinic acid, 1,2-propylenediamine-N-N'-disuccinic acid, 1,3-propylenediamine-N-N'-disuccinic acid, cis-cyclohexanediamine-N-N'-disuccinic acid, trans-cyclohexanediamine-N-N'-disuccinic acid, ethylenebis (oxyethylenenitrilo)-N-N'-disuccinic acid, or combinations thereof, and said polyamino monosuccinic acid is, respectively, ethylenediamine monosuccinic acid, diethylenetriamine monosuccinic acid, triethylenetetraamine monosuccinic acid, 1,6-hexamethylenediamine monosuccinic acid, tetraethylenepentamine monosuccinic acid, 2-hydroxypropylene-1,3-diamine monosuccinic acid, 1,2-propylenediamine monosuccinic acid, 1,3-propylenediamine monosuccinic acid, cis-cyclohexanediamine monosuccinic acid, trans-cyclohexanediamine monosuccinic acid or ethylenebis (oxyethylenenitrilo)monosuccinic acid.

41. The solution of claim 36 wherein said polyamino disuccinic acid is ethylenediamine-N,N'-disuccinic acid, and said polyamino monosuccinic acid is ethylenediaminemonosuccinic acid.

42. The solution of claim 41 wherein said polyamino disuccinic acid is the isomer of ethylenediaminedisuccinic acid.

43. The solution of claim 36 wherein the metal in the metal complexes is selected from iron, manganese, cobalt and copper.

44. The solution of claim 43 wherein the metal is iron.

45. The solution of claim 36 wherein said polyamino disuccinic acid has only two nitrogens to which succinic acid or a salt group thereof are attached, which nitrogens are also bonded to at least one alkylene group and have their remaining valence filled with hydrogen, alkyl or alkylene groups.

46. The solution of claim 45 wherein, in said polyamino disuccinic acid, the two nitrogens to which succinic acid or salt groups thereof are attached also have hydrogen as one substituent thereon.

47. An aqueous photographic bleach-fixing solution comprising a silver halide solvent, and as the bleaching agent, a metal complex of a polyamino disuccinic acid, and a metal complex of a polyamino monosuccinic acid, wherein the polyamino substituent of the polyamino disuccinic acid and the polyamino substituent of the polyamino monosuccinic acid are the same.

48. The solution of claim 47 wherein said bleaching agent is a combination of a ferric complex of a polyamino disuccinic acid and a ferric complex of a polyamino monosuccinic acid.

49. The solution of claim 48 wherein said polyaminodisuccinic acid is ethylenediamine-N-N'-disuccinic acid, diethylenetriamine-N-N"-disuccinic acid, triethylenetetraamine-N-N'"-disuccinic acid, 1,6-hexamethylenediamine-N-N'-disuccinic acid, tetraethylenepentamine-N-N""-disuccinic acid, 2-hydroxypropylene-1,3-diamine-N-N'-disuccinic acid, 1,2-propylenediamine-N-N'-disuccinic acid, 1,3-propylenediamine-N-N'-disuccinic acid, cis-cyclohexanediamine-N-N'-disuccinic acid, trans-cyclohexanediamine-N-N'-disuccinic acid, ethylenebis (oxyethylenenitrilo)-N-N'-disuccinic acid, or combinations thereof, and said polyamino monosuccinic acid is, respectively, ethylenediamine monosuccinic acid, diethylenetriamine monosuccinic acid, triethylenetetraamine monosuccinic acid, 1,6-hexamethylenediamine monosuccinic acid, tetraethylenepentamine monosuccinic acid, 2-hydroxypropylene-1,3-diamine monosuccinic acid, 1,2-propylenediamine monosuccinic acid, 1,3-propylenediamine monosuccinic acid, cis-cyclohexanediamine monosuccinic acid, trans-cyclohexanediamine monosuccinic acid or ethylenebis (oxyethylenenitrilo)monosuccinic acid.

50. The solution of claim 49 wherein said polyamino disuccinic acid is ethylenediamine-N,N'-disuccinic acid, and said polyamino monosuccinic acid is ethylenediaminemonosuccinic acid.

51. The solution of claim 50 wherein said polyamino disuccinic acid is the isomer of ethylenediaminedisuccinic acid.

52. The solution of claim 47 wherein said bleaching agents are present in a total amount of from 0.05 to 1 mol/l.

* * * * *